US008843028B2

(12) United States Patent
Suzuki et al.

(10) Patent No.: US 8,843,028 B2
(45) Date of Patent: Sep. 23, 2014

(54) IMAGE FORMING APPARATUS INCLUDING AN APPARATUS BODY AND AN ALTERNATIVE CARTRIDGE

(75) Inventors: Kensuke Suzuki, Tagata-gun (JP); Daisuke Hiramatsu, Numazu (JP); Takashi Akutsu, Odawara (JP); Tsutomu Nishiuwatoko, Numazu (JP); Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/313,803

(22) Filed: Dec. 7, 2011

(65) Prior Publication Data

US 2012/0155917 A1 Jun. 21, 2012

(30) Foreign Application Priority Data

Dec. 16, 2010 (JP) ..... 2010-281054

(51) Int. Cl.
*G03G 15/04* (2006.01)
*G03G 21/16* (2006.01)
*G03G 15/08* (2006.01)

(52) U.S. Cl.
CPC ..... *G03G 21/1676* (2013.01); *G03G 15/0837* (2013.01); *G03G 2215/018* (2013.01)
USPC ..... 399/119

(58) Field of Classification Search
CPC ..... G03G 15/0837
USPC ..... 399/119
See application file for complete search history.

(56) References Cited

U.S. PATENT DOCUMENTS

| | | | | |
|---|---|---|---|---|
| 7,813,670 | B2 * | 10/2010 | Matsuda | 399/111 |
| 7,983,597 | B2 | 7/2011 | Kikuchi | |
| 2003/0215268 | A1 * | 11/2003 | Kita | 399/258 |
| 2010/0135691 | A1 * | 6/2010 | Kikuchi | 399/111 |

FOREIGN PATENT DOCUMENTS

| | | | |
|---|---|---|---|
| JP | 2010-078955 | A | 4/2010 |
| JP | 2010078955 | A * | 4/2010 |

* cited by examiner

*Primary Examiner* — David Gray
*Assistant Examiner* — Tyler Hardman
(74) *Attorney, Agent, or Firm* — Canon USA Inc IP Division

(57) ABSTRACT

Provided is an image forming apparatus. The image forming apparatus is provided with guide portions to be used to mount a cartridge group including plural cartridges in the image forming apparatus. Some of the guide portions are used also to mount an alternative cartridge, which is configured to occupy two or more of plural mounting spaces, in the image forming apparatus.

4 Claims, 10 Drawing Sheets

IMAGE FORMING APPARATUS INCLUDING AN APPARATUS BODY AND AN ALTERNATIVE CARTRIDGE

BACKGROUND OF THE INVENTION

1. Field of the Invention

The present invention relates to an image forming apparatus equipped with a removable cartridge.

2. Description of the Related Art

An image forming apparatus employing the electrophotographic technology prints an image in the following way. First, an image carrier (hereinafter, referred to as "photosensitive drum") uniformly charged by a charging device is selectively exposed to light by an exposure device, and thereby a latent image is formed on the photosensitive drum. Then, the latent image is developed with a developer (toner) by a developing device, and the developed image is transferred onto a print medium. Thereafter, the transferred image on the print medium is fixed with pressure and heat by a fixing device, and thereby an image is printed on the print medium.

To allow an electrophotographic apparatus to form multicolor images, a configuration known as the "4-pass printing" configuration disclosed in U.S. Pat. No. 7,983,597 has been proposed and put into practical use. In the 4-pass printing configuration, plural fixed developing devices containing developers of different colors are provided around a single photosensitive drum, and form images of their respective colors on the photosensitive drum one after another. Then, the color images thus formed are overlaid one upon another on an intermediate transfer body. Thereafter, all the overlaid color images are together transferred onto a print medium to form a multicolor image on the print medium.

Such electrophotographic image forming apparatuses require maintenance work such as refilling of the toners and adjusting/replacing parts after a certain period of use. One of methods put into practical use to make the maintenance work easier is use of developer cartridges each formed as a unit including a toner and a developing device, and configured to be removably mountable in the image forming apparatus.

In addition, Japanese Patent Laid-Open No. 2010-078955 discloses another image forming apparatus configured to allow a larger-capacity image forming unit to be mounted in a space for mounting standard-capacity image forming units.

SUMMARY OF THE INVENTION

The present invention has been further developed on the basis of the above-described conventional techniques, and simplifies a structure of an image forming apparatus designed to allow a user to use different types of cartridges according to his/her intended purpose.

Further features of the present invention will become apparent from the following description of exemplary embodiments with reference to the attached drawings.

DESCRIPTION OF THE EMBODIMENTS

Figure 1A:
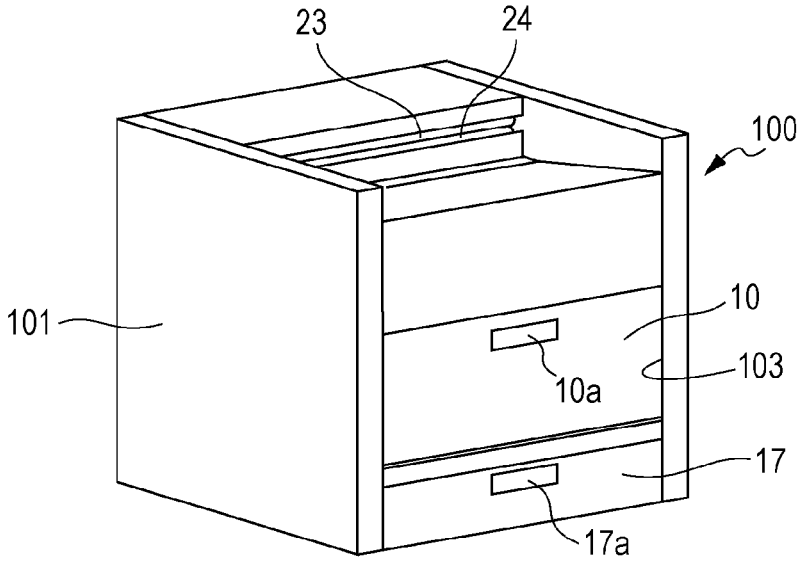
FIG. 1A is a perspective view illustrating the external appearance of an image forming apparatus.

An embodiment of the invention is described below in detail by referring to the drawings.

(Overall General Configuration of Image Forming Apparatus)

Figure 1B:
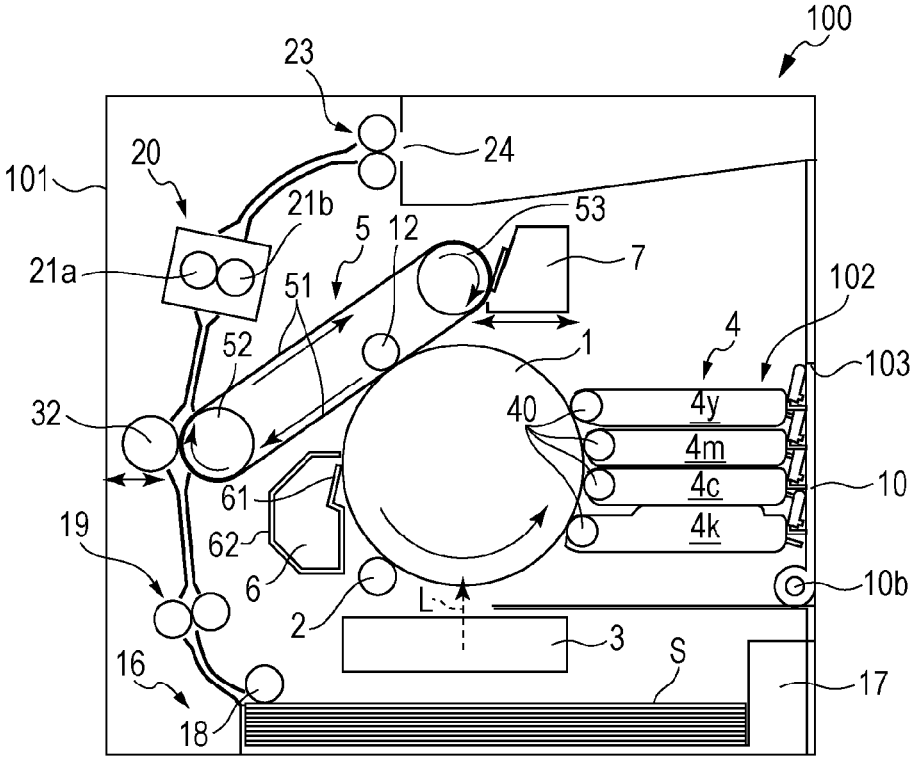
FIG. 1B is a right-side vertical sectional view schematically illustrating the image forming apparatus.

FIG. 1A is a perspective view illustrating the external appearance of an image forming apparatus 100 according to this embodiment, and FIG. 1B is a right-side vertical sectional view schematically illustrating the image forming apparatus 100. The image forming apparatus 100 is a full-color laser printer using toners of four different colors and performing printing relying on electrophotographic processes. The image forming apparatus 100 forms images on a sheet-like print medium S on the basis of electric image signals inputted from a host device (not illustrated), such as a personal computer, an image reader, or a fax machine of the communication counterpart to a controller circuit (not illustrated).

In the following description, the anterior side or the front side of the image forming apparatus 100 refers to the side where a door 10 to open/close the image forming apparatus 100 is provided. The opposite side of the image forming apparatus 100 is referred to as the rear side. The front-rear directions of the image forming apparatus 100 include the direction from the rear side to the anterior side (the forward direction) and the opposite direction (the rearward direction). The left side and the right side of the image forming apparatus 100 refer respectively to the left side and the right side of the apparatus 100 seen from the anterior side. The left-right directions include the direction from the right side to the left side (the leftward direction) and the opposite direction (the rightward direction). An apparatus main body 101 refers to a portion of the image forming apparatus 100 excluding cartridges.

An electrophotographic photosensitive drum 1 (hereinafter, referred simply to as the "drum 1") is provided in the substantially central portion of the apparatus main body 101. The drum 1 serves as an image carrier where a latent image is formed. The drum 1 is driven to rotate in the counterclockwise direction indicated by the arrow in FIG. 1. Around the drum 1, various processing units to perform their respective operations on the drum 1 are provided such as a charging unit 2, an image exposure unit 3, a development unit 4, an intermediate transfer unit 5, and a drum cleaning unit 6, which are arranged in this order along the drum rotating direction.

The drum 1 is formed by coating an organic photoconductive layer (OPC photoconductive body) onto the external circumferential surface of a cylinder made, for instance, of aluminum. The drum 1 is placed with its drum axis aligned in the left-right directions. The apparatus main body 101 is provided with a left support member (not illustrated) and a right support member (not illustrated) that support two ends of the drum 1 in a freely rotatable manner. A driving-force transmission unit (not illustrated), which is configured to receive the driving force from a driving motor (not illustrated), is provided at one of the two ends of the drum 1. The drum 1 is driven to rotate in the counterclockwise direction indicated by the arrow in FIG. 1 at a predetermined speed by the driving force transmitted to the driving-force transmission unit.

The charging unit 2 of this embodiment employs a contact charging method, and includes, as a contact charging member, a charge roller (conductive roller) formed in a roller-like shape. The charge roller 2 is placed substantially in parallel to the drum 1 and in contact with the drum 1, so that the charge roller 2 is driven to rotate by the rotation of the drum 1. A power supply unit (not illustrated) is provided to apply a predetermined charging bias voltage to the charge roller 2. With the charging bias voltage, the surface of the drum 1 is uniformly charged to have a predetermined polarity and a predetermined potential.

The image exposure unit 3 of this embodiment is a laser scanner unit provided under the drum 1. The unit 3 includes a laser diode, a polygon mirror, an Fθ lens, a reflector mirror, and the like. The unit 3 emits laser beams L so that the charged surface of the drum 1 can be scanned and exposed to laser beams L, which is modulated in accordance with information on the different-color images, the information being inputted from host device to the controller circuit. Thus, an electrostatic latent image corresponding to the scanning-exposure pattern is formed on the surface of the drum 1.

The development unit 4 is a device to visualize the electrostatic latent image formed on the drum 1 by using the developer, i.e. toner. In this embodiment, first to fourth development devices 4*y*, 4*m*, 4*c*, and 4*k* containing toners of different colors are provided, as developing units, between the drum 1 and the door 10, one adjacent to another in the vertical directions. The developing devices 4*y*, 4*m*, 4*c*, and 4*k* are developer cartridges (hereinafter, referred simply to as the "cartridges"), which are removably mounted in a cartridge mounting portion 102 of the apparatus main body 101. The four cartridges 4*y*, 4*m*, 4*c*, and 4*k* form a "cartridge group" which includes plural cartridges simultaneously mountable in the apparatus main body 101.

The first cartridge 4*y* contains a yellow-color (y-color) toner used as the developer. Hereinafter, the cartridge 4*y* is referred to as the "yellow cartridge." The second cartridge 4*m* contains a magenta-color (m-color) toner used as the developer. Hereinafter, the cartridge 4*m* is referred to as the "magenta cartridge." The third cartridge 4*c* contains a cyan-color (c-color) toner used as the developer. Hereinafter, the cartridge 4*c* is referred to as the "cyan cartridge." The fourth cartridge 4*k* contains a black-color (k-color) toner used as the developer. Hereinafter, the cartridge 4*k* is referred to as the "black cartridge."

Each of the cartridges 4*y*, 4*m*, 4*c*, and 4*k* includes a developing roller 40 configured to supply the corresponding toner to the drum 1. In addition, each of the cartridges 4*y*, 4*m*, 4*c*, and 4*k* includes a toner container (developer container), where the corresponding toner is held. Although not illustrated in FIG. 1B, each of the cartridges 4*y*, 4*m*, 4*c*, and 4*k* also includes a toner applying member, a developing blade, a toner agitating/transporting member, and the like. Here, the toner applying member is configured to apply toner to the corresponding developing roller 40. The developing blade is configured to regulate the layer thickness of the applied toner and to give electrical charges to the toner.

The four cartridges 4*y*, 4*m*, 4*c*, and 4*k* are selectively controlled to perform developing operations to develop the electrostatic latent image formed on the drum 1. To be specific, the developing roller 40 and the other members in the selected cartridge are driven while a predetermined developing bias is applied from the power supply unit (not illustrated) to the developing roller 40. Thus, the electrostatic latent image formed on the drum 1 is developed by the selected cartridge.

Figure 9:
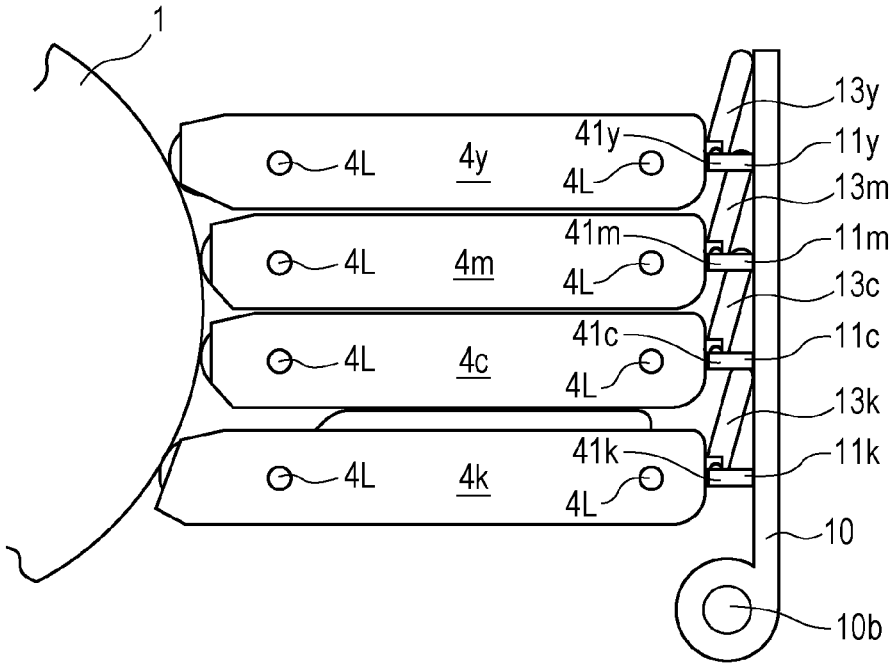
FIG. 9 is a side view illustrating the configuration around the cartridges mounted in the main body of the image forming apparatus and biased by biasing members.

Biasing members 11*y*, 11*m*, 11*c*, and 11*k* are provided on the door 10, and are configured to bias, respectively, the cartridges 4*y*, 4*m*, 4*c*, and 4*k* towards the drum 1. FIG. 9 illustrates a left-side vertical section of a portion of the image forming apparatus 100 with the cartridges 4*y*, 4*m*, 4*c*, and 4*k* mounted in the apparatus 100 and the door 10 closed. FIG. 9 illustrates an enlarged portion around the cartridges 4*y*, 4*m*, 4*c*, and 4*k*. The cartridges 4*y*, 4*m*, 4*c*, and 4*k* have biased surfaces 41*y*, 41*m*, 41*c*, and 41*k*, respectively. Each of the biased surfaces 41*y*, 41*m*, 41*c*, and 41*k* is the trailing-end surface of the corresponding one of the cartridges 4*y*, 4*m*, 4*c*, and 4*k* being inserted in the cartridge mounting portion 102. If the cartridges 4*y*, 4*m*, 4*c*, and 4*k* are mounted in the apparatus main body 101 and the door 10 is closed, the leading ends of the biasing members 11*y*, 11*m*, 11*c*, and 11*k* are in contact respectively with the biased surfaces 41*y*, 41*m*, 41*c*, and 41*k*, and thereby bias their corresponding cartridges 4*y*, 4*m*, 4*c*, and 4*k* towards the drum 1. In contrast, if the door 10 is opened, the leading ends of the biasing members 11*y*, 11*m*, 11*c*, and 11*k* are not in contact respectively with the biased surfaces 41*y*, 41*m*, 41*c*, and 41*k*, and do not bias their corresponding cartridges 4*y*, 4*m*, 4*c*, and 4*k* towards the drum 1.

The intermediate transfer unit 5 of this embodiment is an intermediate transfer-belt unit. The unit 5 includes a dielectric, flexible, and endless intermediate transfer belt 51 (hereinafter, simply referred to as the "belt 51") serving as an intermediate transfer body. In addition, the unit 5 also includes a first roller 52, a second roller 53, and a primary transfer roller 12. The belt 51 is looped around the first roller 52 and the second roller 53. The primary transfer roller 12 is provided between the first roller 52 and the second roller 53. The primary transfer roller 12 is pressed against the drum 1 with the belt 51 sandwiched in between. The portion where the drum 1 and the belt 51 are in contact with each other is referred to as a "primary-transfer nip portion."

A secondary transfer roller 32 is provided facing the belt-wrapped portion of the first roller 52. The secondary transfer roller 32 is moved by a transport mechanism (not illustrated) from a working position to a non-working position, or vice versa. The working position refers to the position where the secondary transfer roller 32 is pressed against the first roller 52 with the belt 51 sandwiched in between. The non-working position refers to the position where the secondary transfer roller 32 is separated away from the belt 51. The secondary transfer roller 32 is held at the non-working position at ordinary times, and is moved to the working position at predetermined control timings. The portion where the secondary transfer roller 32 that is in the working position and the belt 51 are in contact with each other is referred to as a "secondary-transfer nip portion."

A belt cleaning unit 7 configured to clean the surface of the belt 51 is provided at the belt-wrapped portion of the second roller 53. The belt cleaning unit 7 is moved by a transport mechanism (not illustrated) from a working position to a non-working position, or vice versa. The working position refers to the position where a cleaning member is in contact with the surface of the belt 51. The non-working position refers to the position where the cleaning member is separated away from the surface of the belt 51. The belt cleaning unit 7 is held in the non-working position at ordinary times, and is moved to the working position at predetermined control timings.

The drum cleaning unit 6 is configured to remove the toner that still remains on the surface of the drum 1 even after the toner image is primarily transferred onto the belt 51. The drum cleaning unit 6 of this embodiment includes a cleaning blade 61 serving as a cleaning member. The toner thus removed from the surface of the drum 1 is collected in a cleaner container 62.

Upon receiving a signal to start image formation, the controller circuit drives to start a main motor (not illustrated). Thus, the drum 1 is driven to rotate at a predetermined speed. In addition, the belt 51 is also driven to rotate in the same direction that the drum 1 rotates and at the rotating speed corresponding to the rotating speed of the drum 1. In the meanwhile, both the secondary transfer roller 32 and the belt cleaning unit 7 are moved to and held at their respective non-working positions away from the belt 51. Then, a predetermined charging bias is applied to the charge roller 2, so that the surface of the rotating drum 1 is uniformly charged to have a predetermined polarity and a predetermined potential. Thereafter, the laser scanner unit 3 emits laser beams L modulated in accordance with a signal for the y-color-component image of the full-color image. Thus, the surface of the drum 1 is scanned by and exposed to the laser beams L. As a consequence, an electrostatic latent image for the y-color-component image is formed on the surface of the drum 1. The electrostatic latent image thus formed is then developed as a y-color toner image (developer image) by the yellow cartridge 4*y* controlled to perform the developing operations. The y-color toner image is then primarily transferred onto the surface of the belt 51 at the primary-transfer nip portion. A primary-transfer bias is applied by the power supply unit (not illustrated) to the primary transfer roller 12 at a predetermined control timing. The primary-transfer bias has a predetermined potential and a polarity that is opposite to the polarity of the charged toner. Once the primary transfer is finished, the surface of the drum 1 is cleaned by the drum cleaning unit 6.

After the primary transfer of the y-color toner image to the belt 51, a charging process, an exposure process, and a development process are carried out to form an m-color toner image, which corresponds to the m-color-component image of the full-color image, on the surface of the drum 1. The m-color toner image thus formed is primarily transferred, at the primary-transfer nip portion, to be laid over the y-color toner image that has been transferred onto the belt 51. The m-color toner image is aligned at a predetermined position relative to the y-color toner image.

After the primary transfer of the m-color toner image to the belt 51, a charging process, an exposure process, and a development process are carried out to form a c-color toner image, which corresponds to the c-color-component image of the full-color image, on the surface of the drum 1. The c-color toner image thus formed is primarily transferred, at the primary-transfer nip portion, to be laid over the y-color and m-color toner images that have been transferred onto the belt 51. The c-color toner image is aligned at a predetermined position relative to the y-color and m-color toner images.

After the primary transfer of the c-color toner image to the belt 51, a charging process, an exposure process, and a development process are carried out to form a k-color toner image, which corresponds to the k-color-component image of the full-color image, on the surface of the drum 1. The k-color toner image thus formed is primarily transferred, at the primary-transfer nip portion, to be laid over the y-color, m-color, and c-color toner images that have been transferred onto the belt 51. The k-color toner image is aligned at a predetermined position relative to the y-color, m-color, and c-color toner images.

In this way, an unfixed full-color toner image of four different color toners, namely, y-color, m-color, c-color, and k-color toners, is synthetically formed on the belt 51.

Note that in this embodiment, the toner images of the four different colors are formed on the surface of the drum 1 sequentially by forming firstly the y-color one, then the m-color one, subsequently the c-color one, and finally the k-color one. The order of forming the four toner images of this embodiment is not the only possible order. The order may be arbitrarily determined.

The unfixed full-color toner image of four different color toners formed on the belt 51 moves along with the rotation of the belt 51. Before the leading-end portion of the unfixed full-color toner image reaches the position of the secondary transfer roller 32, the secondary transfer roller 32 is moved to its working position, where the secondary transfer roller 32 is in contact with the belt 51. In addition, at a predetermined timing, the belt cleaning unit 7 is also moved to its own working position, where the belt cleaning unit 7 cleans the belt 51.

In the meanwhile, a feeder roller 18 of a feeder unit 16 is driven at a predetermined timing. Thereby, a single one of the sheet-like print media S that are stacked one upon another in a feeder cassette 17 is separated away from the other print media S, and is transported. The feeder cassette 17 can be inserted into and pulled out of the apparatus main body 101 from the anterior side of the apparatus main body 101 (front loading) A handle portion 17*a* if provided on the front side of the feeder cassette 17. The single print medium S thus transported is then introduced into the secondary-transfer nip portion, which is the portion where the secondary transfer roller 32 is in contact with the belt 51, by a resist roller pair 19 at a predetermined timing. A secondary-transfer bias is applied to the secondary transfer roller 32 by the power supply unit (not illustrated). The secondary-transfer bias has a predetermined potential and a polarity that is opposite to the polarity of the charged toner. Thus, while the single print medium S held by and between the secondary transfer roller 32 and the belt 51 is being transported through the secondary-transfer nip portion, all the toner images of the four different colors that are laid one upon another on the belt 51 are secondarily transferred sequentially onto the surface of the print medium S.

Then, the single print medium S is separated from the surface of the belt 51, and then introduced into a fixing unit 20. The fixing unit 20 is configured to fix the toner images with plural colors transferred onto the surface of the print medium S (the toner images are fixed by melting the toners and mixing the colors). The fixing unit 20 includes a rotatable heating roller 21*b* and a pressurizing roller 21*a*, which is pressed against the heating roller 21*b* to provide heat and pressure to the print medium S. While the print medium S with the toner images transferred thereon from the drum 1 is passing through the fixing unit 20, the print medium S is held and transported between the fixing-roller pair, that is, the pressurizing roller 21*a* and the heating roller 21*b*. In the meanwhile, the fixing-roller pair 21*a* and 21*b* give pressure and heat to the print medium S. Thus, the toner images of the plural colors are fixed to the surface of the print medium S. Then, the print medium S moves out of the fixing unit 20. Thereafter, a discharge-roller pair 23 discharges the print medium S, as a full-color-image formed object, out of the apparatus main body 101 through a discharging portion 24.

When the image forming apparatus 100 is in the monochrome-image forming mode, images are formed by using only the black cartridge 4*k*.

(Cartridge Replacement Method)

As the cartridges 4*y*, 4*m*, 4*c*, and 4*k* are used to form images, the developers (toners) contained in the cartridges 4*y*, 4*m*, 4*c*, and 4*k* are consumed.

Hence, each of the cartridges 4*y*, 4*m*, 4*c*, and 4*k* is provided with, for instance, a detector unit (not illustrated) to detect how much developer still remains in the cartridge. Then, the controller circuit compares the detected amount of remaining toner with a preset threshold for making a life-end advance notice or alert for the cartridge. If the detected amount of remaining toner of a cartridge is less than the threshold, a life-end advance notice or alert for the cartridge is displayed by a display unit (not illustrated). The life-end advance notice or the alert urges the user to obtain a new cartridge for replacement, or to replace the currently-used cartridge with a new one. Thus, the quality of the output image can be kept high.

To improve the usability, the image forming apparatus 100 of this embodiment adopts the front-access replacement method as a method of replacing the cartridges.

Figure 2:
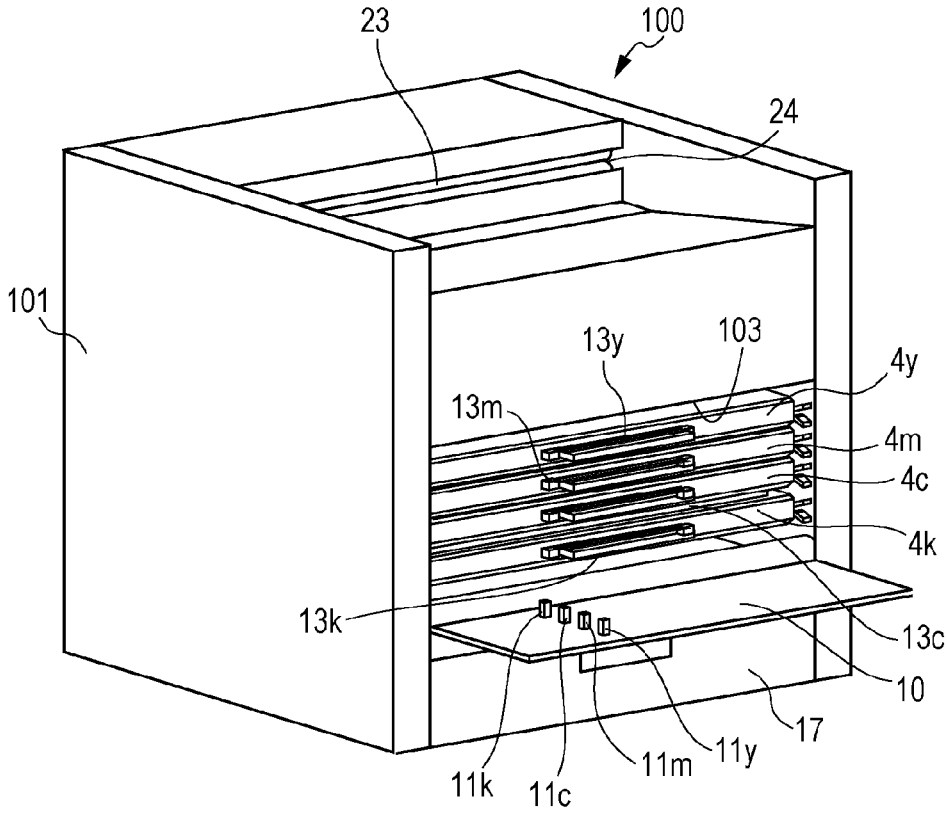
FIG. 2 is a perspective view illustrating the external appearance of the image forming apparatus with a door opened.

An opening portion 103 is formed on the front side of the apparatus main body 101. Cartridges are inserted into or taken out of the cartridge mounting portion 102 through the opening portion 103. The door 10 is provided as an opening/closing member, and is movable from a closing position were the door 10 covers the opening portion 103, to an opening position where the door 10 uncovers the opening portion 103, and vice versa. The door 10 of this embodiment can be opened or closed by rotating relative to the apparatus main body 101 about a horizontal shaft (hinge shaft) 10*b* located at the bottom side of the door 10. To put it differently, the door 10 can be rotated about the hinge shaft 10*b* in a direction that makes the door 10 stand upright, and can thereby be confined into the opening portion 103 of the apparatus main body 101 as shown in FIG. 1. The confinement of the door 10 closes the opening portion 103. In contrast, the door 10 can be rotated about the hinge shaft 10*b* in a direction that makes the door 10 lie down on the anterior side of the apparatus main body 101. Thus the door 10 can be opened relative to the apparatus main body 101, as shown in FIG. 2. The rotational movement in this direction opens the opening portion 103 on the front side of the apparatus main body 101. The door 10 is provided with a handle portion 10*a*. If the door 10 is opened while the cartridges 4*y*, 4*m*, 4*c*, and 4*k* are mounted in the cartridge mounting portions 102, the front sides (external surfaces) of the cartridges 4*y*, 4*m*, 4*c*, and 4*k* are exposed out in the opening portion 103 as shown in FIG. 2.

Figure 3A:
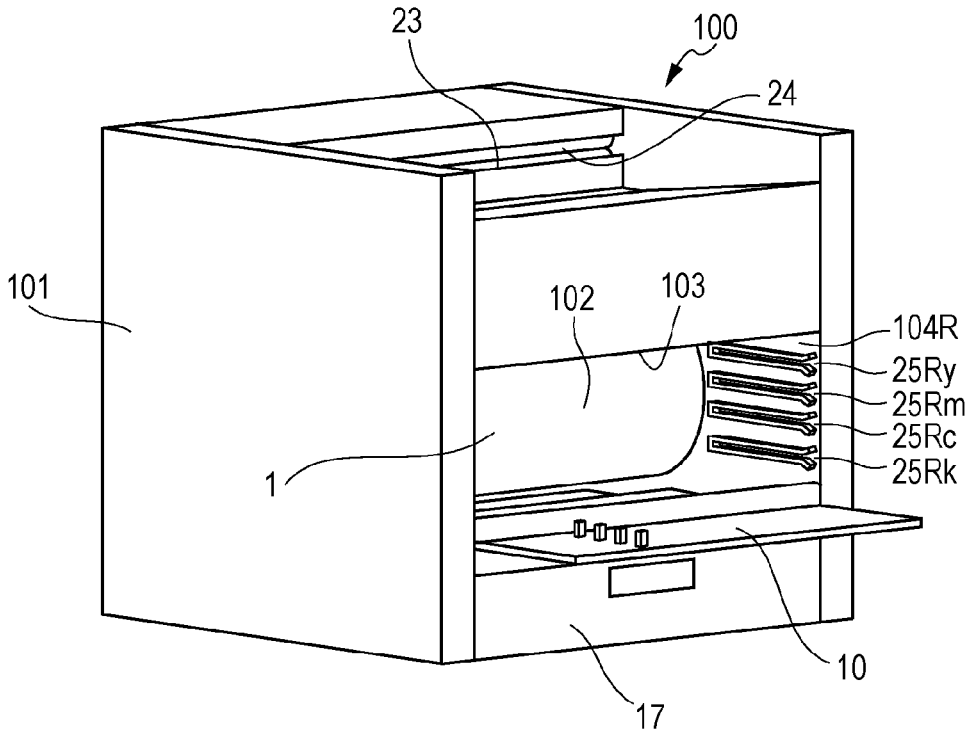
FIGS. 3A and 3B are perspective views, seen from different angles, each of which illustrates the main body of the image forming apparatus with the door opened and with no cartridges mounted in a cartridge mounting portion.
Figure 3B:
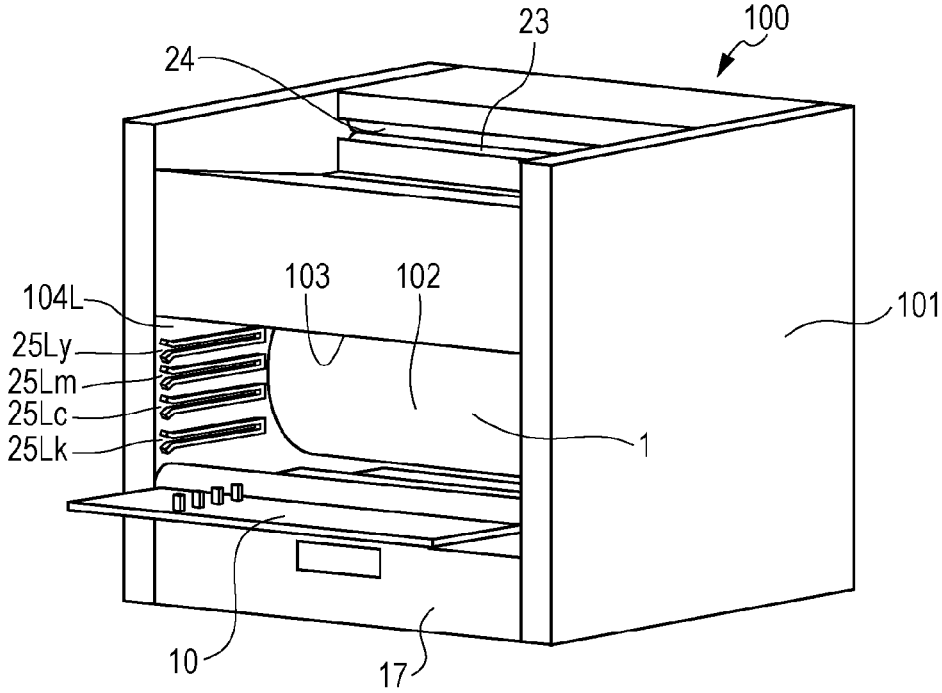
Figure 4:
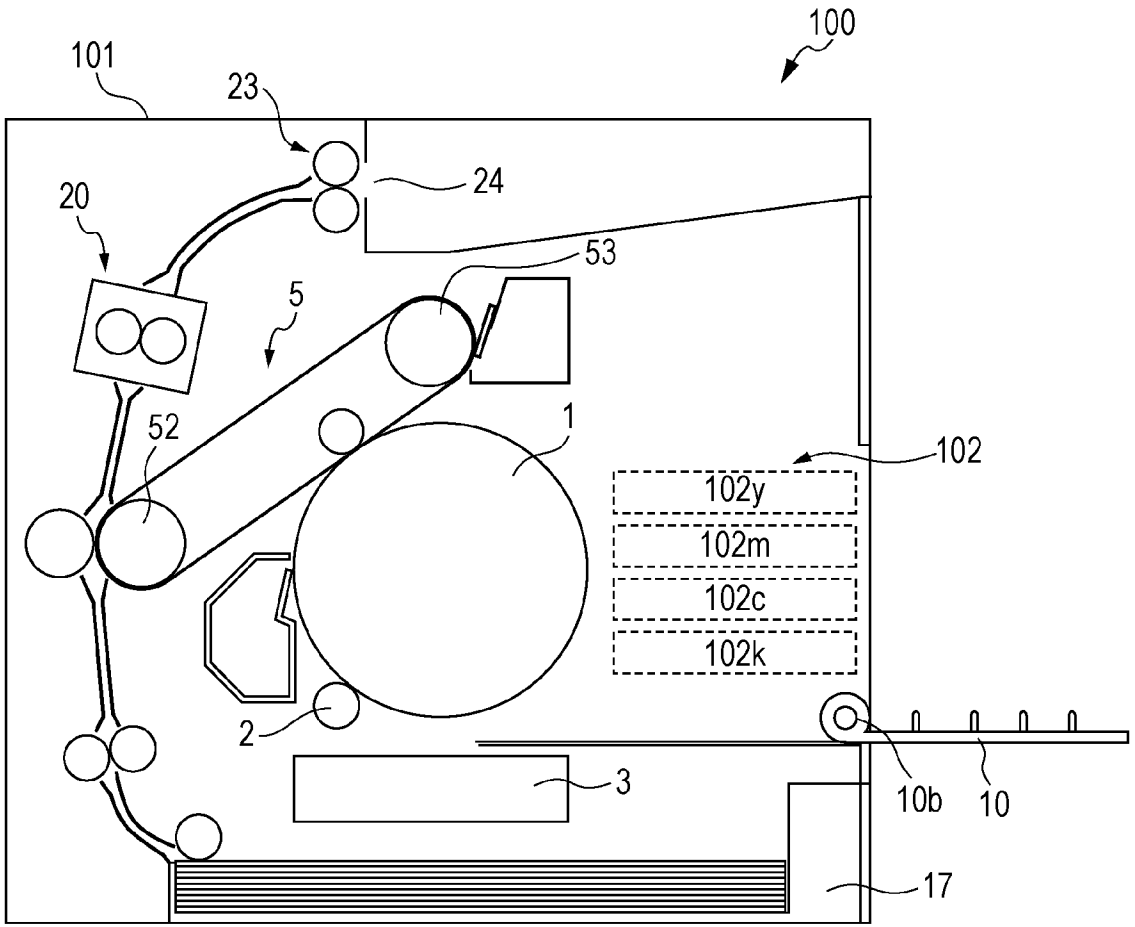
FIG. 4 is a sectional view illustrating the main body of the image forming apparatus with the door opened and with no cartridges mounted in the cartridge mounting portion.

FIGS. 3A and 3B are perspective views illustrating the apparatus main body 101 with the door 10 opened and none of the cartridges 4*y*, 4*m*, 4*c*, and 4*k* mounted in the cartridge mounting portion 102. FIGS. 3A and 3B are views seen from different angles from each other. FIG. 4 is a sectional view of the apparatus main body 101 with the door 10 opened and none of the cartridges 4*y*, 4*m*, 4*c*, and 4*k* mounted in the cartridge mounting portion 102. The cartridge mounting portion 102 refers to a space (cartridge mounting space) that is occupied by the cartridges 4*y*, 4*m*, 4*c*, and 4*k* if the cartridges 4*y*, 4*m*, 4*c*, and 4*k* are mounted in the apparatus main body 101. The space where the yellow cartridge 4*y* is mounted is referred to as a "cartridge mounting portion 102*y*." The space where the magenta cartridge 4*m* is mounted is referred to as a "cartridge mounting portion 102*m*." The space where the cyan cartridge 4*c* is mounted is referred to as a "cartridge mounting portion 102*c*." The space where the black cartridge 4*k* is mounted is referred to as a "cartridge mounting portion 102*k*." In the cartridge mounting portion 102, each pair of guide portions 25R and 25L ("cartridge-mounting-and-removing guide portions") are formed in the internal walls of a right frame 104R and a left frame 104L, respectively, of the apparatus main body 101. The guide portions 25R and 25L are arranged facing each other and are configured to guide a cartridge in mounting or removing the cartridge in or from the cartridge mounting portion 102. In this embodiment, four pairs of the guide portions 25R and 25L, which are provided one adjacent to another in the vertical directions, are provided so as to respectively guide the cartridges 4*y*, 4*m*, 4*c*, and 4*k*. Guide portions 25Ry and 25Ly guide the yellow cartridge 4*y*. Guide portions 25Rm and 25Lm guide the magenta cartridge 4*m*. Guide portions 25Rc and 25Lc guide the cyan cartridge 4*c*. Guide portions 25Rk and 25Lk guide the black cartridge 4*k*.

Figure 5A:
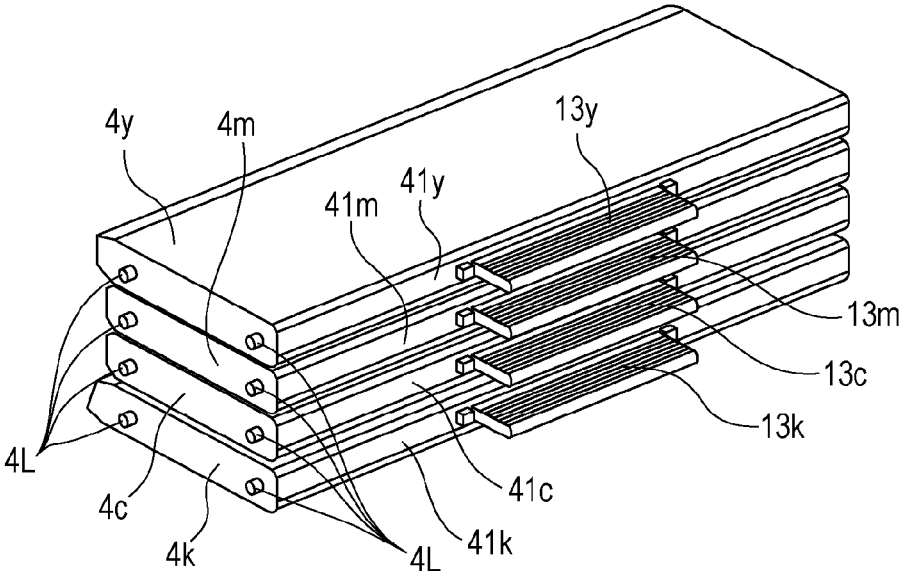
FIG. 5A is a perspective view illustrating plural cartridges seen from the left side of the cartridges.
Figure 5B:
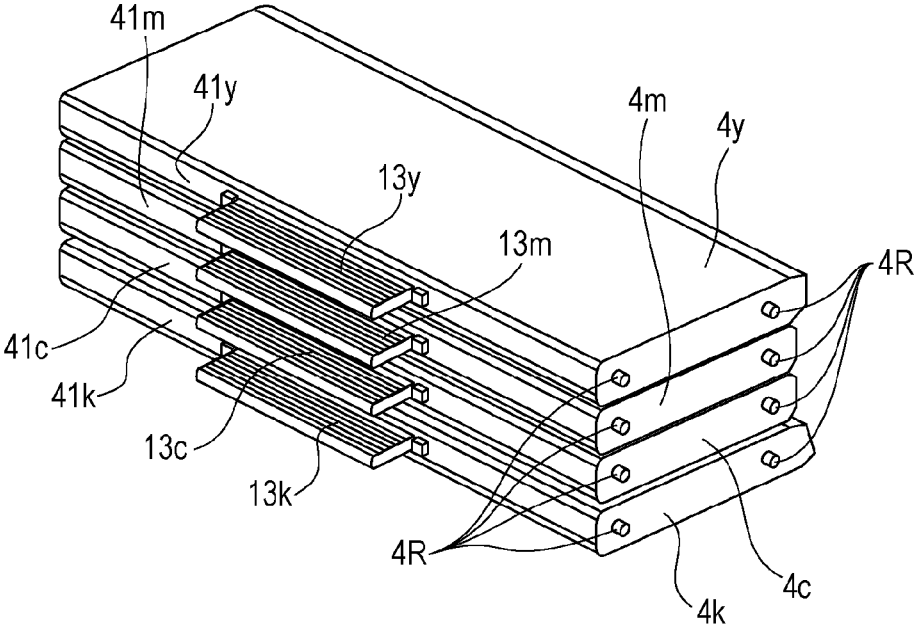
FIG. 5B is a perspective view illustrating the plural cartridges seen from the right side of the cartridges.

FIG. 5A is a perspective view illustrating the cartridges 4*y*, 4*m*, 4*c*, and 4*k* seen from the left side. FIG. 5B is a perspective view illustrating the cartridges 4*y*, 4*m*, 4*c*, and 4*k* seen from the right side. Guided portions 4L and 4R are formed respectively on the left side and on the right side of each of the cartridges 4*y*, 4*m*, 4*c*, and 4*k*. Guided portions 4L and 4R can be engaged with their corresponding guide portions 25L and 25R of the apparatus main body 101. The left guided portions 4L and the right guided portions 4R of the cartridges 4*y*, 4*m*, 4*c*, and 4*k* are engaged with their corresponding left guide portions 25L and the right guide portions 25R of the cartridge mounting portion 102. By sliding the cartridges 4*y*, 4*m*, 4*c*, and 4*k* with the guide portions and guided portions engaged with each other, the cartridges 4*y*, 4*m*, 4*c*, and 4*k* are mounted in or removed from the cartridge mounting portions 102*y*, 102*m*, 102*c*, and 102*k*.

Each of the guide portions 25R and 25L extends in the front-rear directions substantially in a horizontal manner, and the drum 1 is provided beyond the farther ends of the extending guide portions 25R and 25L. The directions in which each of the guide portions 25R and 25L extends substantially coincides with the direction in which the cartridges 4 are moved when the cartridges 4 are mounted in or removed from the apparatus main body 101.

When a user starts to use a new apparatus main body 101, or when a user replace a cartridge 4 that has been used thus far with a new one, the user does the work of mounting the cartridge 4 into the apparatus main body 101, or the user does the work of removing the cartridge 4 from the apparatus main body.

The cartridges 4*y*, 4*m*, 4*c*, and 4*k* are provided respectively with grips 13*y*, 13*m*, 13*c*, and 13*k*. If the user holds the grip 13 with his/her hand, the user can do easily the work of mounting the cartridge 4 in the cartridge mounting portion 102 of the apparatus main body 101 and the work of removing the cartridge 4 from the cartridge mounting portion 102.

The user holds the grip 13 (13*y*, 13*m*, 13*c*, or 13*k*) projected from the external surface of the corresponding cartridge 4, and thereby makes the right guided portion 4R and the left guided portion 4L of the cartridge 4 engage with their corresponding right guide portion 25R and the left guide portion 25L of the cartridge mounting portion 102. Then, the user slides the guided portions 4R and 4L along the guide portions 25R and 25L, and thereby the user inserts the cartridge 4 into the cartridge mounting portion 102. The cartridges 4 are mounted from the front side of the apparatus main body 101 by being moved substantially in the horizontal direction. FIG. 2 shows a state where all the four cartridges 4*y*, 4*m*, 4*c*, and 4*k* are inserted into and mounted in the apparatus main body 101. The cartridges 4*y*, 4*m*, 4*c*, and 4*k* are provided one adjacent to another in a direction X1 (to be specific, in the vertical directions in this embodiment). Thereafter, the user closes the door 10. Thereby the image forming apparatus 100 becomes ready to perform the image forming operations.

When the cartridges 4 are removed from the apparatus main body, the above-described mounting work is performed in the reverse sequence. The user holds one of the grips 13*y*, 13*m*, 13*c*, and 13*k* of the cartridges 4*y*, 4*m*, 4*c*, and 4*k* with his/her hand, and thereby slides the guided portions 4R and 4L along their corresponding guide portions 25R and 25L. Thus, the user removes the cartridges 4 to the outside of the cartridge mounting portion 102.

Now, detailed description is given of the above-described biasing member and the above-described biased surfaces. As described earlier, the internal wall of the door 10 is provided with the four biasing members 11*y*, 11*m*, 11*c*, and 11*k*. Each of the biasing members 11*y*, 11*m*, 11*c*, and 11*k* has a cylindrical shape, and is capable of moving back and forth in a perpendicular direction to the door 10.

The developer cartridges 4*y*, 4*m*, 4*c*, and 4*k* have biased surfaces 41*y*, 41*m*, 41*c*, and 41*k* located on the trailing end in the cartridge-inserting direction. The biased surfaces 41*y*, 41*m*, 41*c*, and 41*k* are located at positions where the leading ends of the biasing members 11*y*, 11*m*, 11*c*, and 11*k* can be brought into contact with the biased surfaces 41*y*, 41*m*, 41*c*, and 41*k* when the door 10 is closed. Each of biased surfaces 41*y*, 41*m*, 41*c*, and 41*k* has a surface substantially orthogonal to the direction in which the cartridges are inserted. If the cartridges 4 are mounted in the apparatus main body and the door 1 is closed, the leading ends of the biasing members 11*y*, 11*m*, 11*c*, and 11*k* are in contact with the biased surfaces 41*y*, 41*m*, 41*c*, and 41*k* of the cartridges 4*y*, 4*m*, 4*c*, and 4*k*. Thereby the biasing members 11*y*, 11*m*, 11*c*, and 11*k* bias the developer cartridges 4*y*, 4*m*, 4*c*, and 4*k* towards the drum 1.

(Monochrome Developer Cartridge)

Figure 6:
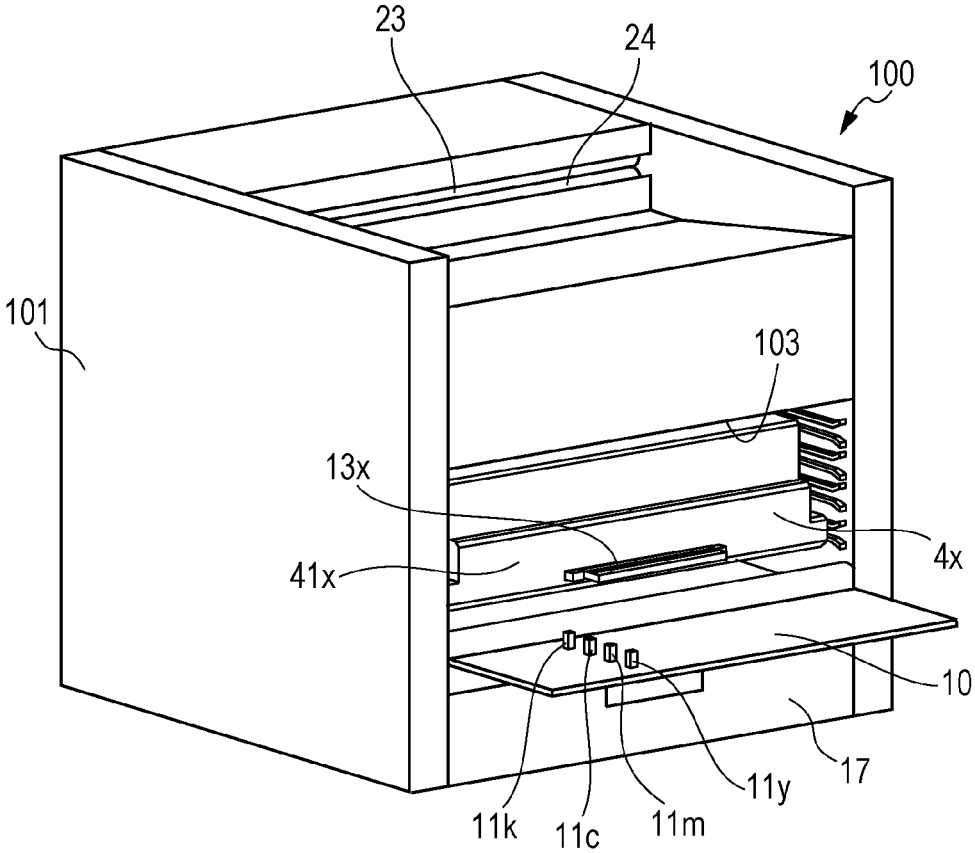
FIG. 6 is a schematic perspective view illustrating the image forming apparatus with the door opened and with a cartridge for monochrome printing (hereinafter simply referred to as the "monochrome cartridge") mounted in the cartridge mounting portion.
Figure 7:
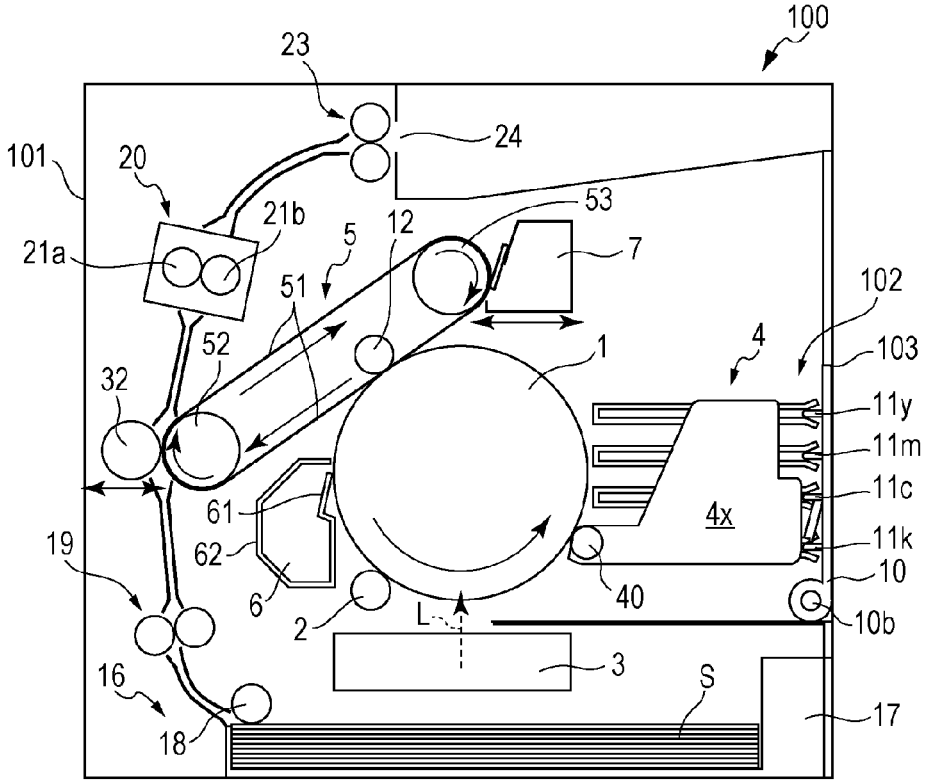
FIG. 7 is a right-side vertical sectional view schematically illustrating the image forming apparatus with the monochrome cartridge mounted in the cartridge mounting portion.
Figure 8A:
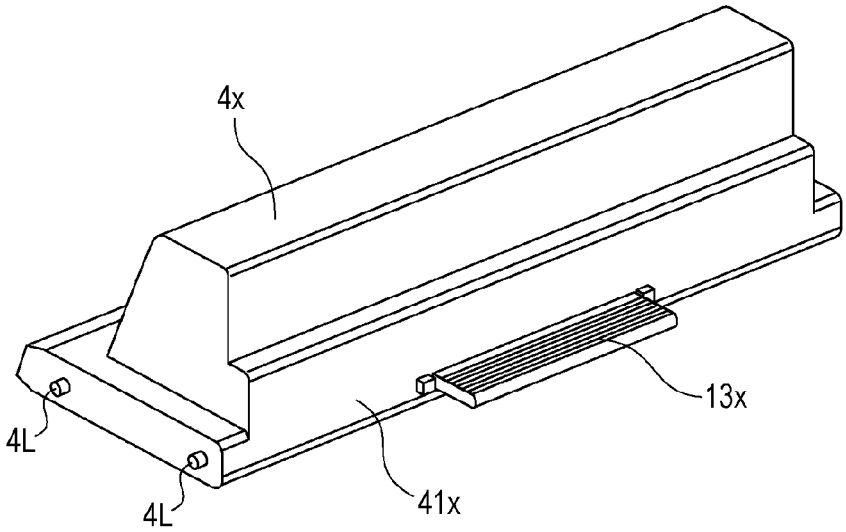
FIG. 8A is a perspective view illustrating the monochrome cartridge seen from the left side of the cartridge.
Figure 8B:
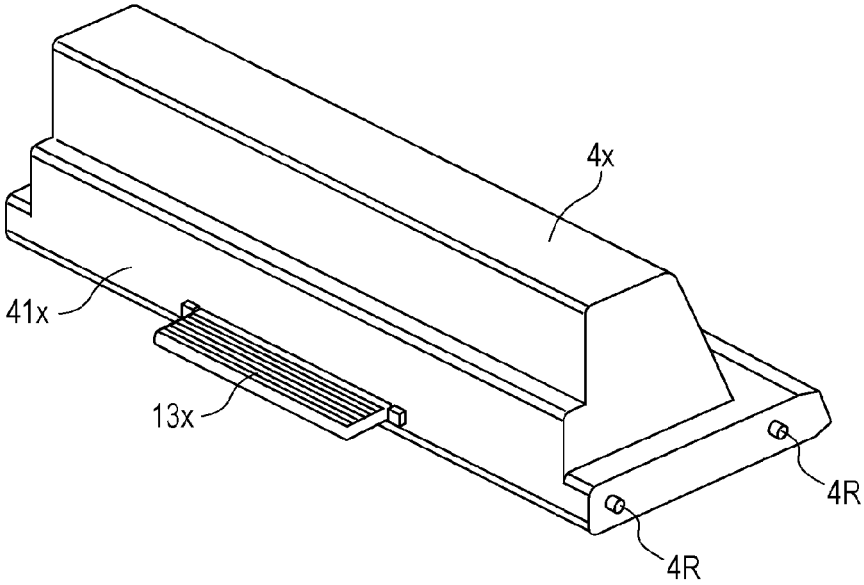
FIG. 8B is a perspective view illustrating the monochrome cartridge seen from the right side of the cartridge.

Monochrome cartridges 4*x* (alternative cartridges) are provided to be used for the image forming apparatus 100 of this embodiment so as to meet the need of the user who performs monochrome printing a lot. The monochrome cartridge 4*x* has a toner container that is larger than the toner container of each of the cartridges 4*y*, 4*m*, 4*c*, and 4*k*. FIG. 6 is a perspective view illustrating the image forming apparatus 100 with the door 10 opened and with the cartridges 4*x* mounted in the apparatus main body 101. FIG. 7 is a right-side vertical sectional view illustrating the image forming apparatus 100 with the cartridges 4*x* mounted in the apparatus main body 101 and with the door 10 closed. FIG. 8A is a perspective view illustrating only the cartridge 4*x* seen from the upper left side, and FIG. 8B is a perspective view illustrating only the cartridge 4*x* seen from the upper right side.

A single monochrome cartridge 4*x* alone occupies the same space of the cartridge mounting portion 102 that accommodates four cartridges 4 of different colors. Hence, the monochrome cartridge 4*x* contains more amount of toner, and therefore allows more sheets to be printed for each single cartridge. In comparison to the cartridge 4*k* for color printing, the monochrome cartridge 4*x* has a shape with a larger toner container extending upwards. The monochrome cartridge 4*x* includes a cartridge frame. The cartridge frame includes a development frame including a developing roller, and also includes a toner frame containing the toner. The main portion of the development frame including both a driving-force transmission mechanism (not illustrated) and a toner transportation mechanism (not illustrated) is identical to the main portion of the cartridge 4*k* for color printing. On the other hand, a larger-capacity toner container of the toner frame is provided specially for the monochrome cartridge 4*x*. Thus, the monochrome cartridge 4*x* can be formed to have a simple configuration with a small number of extra parts.

The monochrome cartridge 4*x* has guided portions 4L and 4R. The guided portions 4L and 4R are engaged with their corresponding guide portions 25, and thereby the monochrome cartridge 4*x* is mounted in the apparatus main body 101. The monochrome cartridge 4*x* is engaged with the same guide portions 25 that one of the cartridges 4 is engaged with. Accordingly, no extra members have to be provided in the apparatus main body 101. Four pairs of guide portions 25Ry and 25Ly, 25Rm and 25Lm, 25Rc and 25Lc, and 25Rk and 25Lk are formed on the internal walls of the apparatus main body 101. Of these four pairs, the guided portions 4L and 4R are engaged respectively with the lowermost guide portions 25Rk and 25Lk when the monochrome cartridge 4*x* is mounted in the apparatus main body 101. As described earlier, the monochrome cartridge 4*x* has a shape with the toner container extending upwards. So, the user of the lowermost guide portions 25Rk and 25Lk for the engagement with the guided portions 4L and 4R allows the user of the space in the cartridge mounting portion 102 to accommodate the monochrome cartridge 4*x* with the toner container extending further upwards. Thus, the monochrome cartridge 4*x* is allowed to contain more toner.

If the user wants to use monochrome cartridge 4*x* instead of the cartridges 4, or when the user wants to replace a monochrome cartridge 4*x* that has been used so far with a new one, the user has to remove the currently-used monochrome cartridge 4*x*, or cartridges 4, and then mount a new monochrome cartridge 4*x* in the apparatus main body 101. The monochrome cartridge 4*x* is provided with a grip 13*x*. As described earlier, when the user removes cartridges 4 from or mounts them in the apparatus main body 101, the user can use the grips 13*y*, 13*m*, 13*c*, and 13*k* to do the job easily. Likewise, when the user removes the monochrome cartridge 4*x* from or mounts it in the cartridge mounting portion 102 of the apparatus main body 101, the user holds the grip 13*x* to do the job easily.

Figure 10:
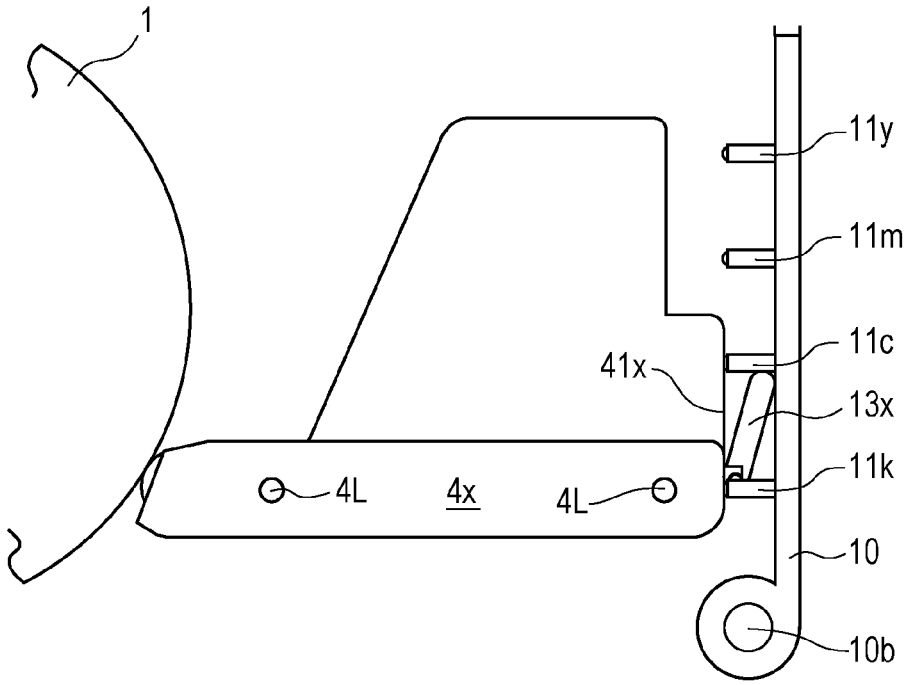
FIG. 10 is a side view illustrating the configuration around the monochrome cartridge mounted in the main body of the image forming apparatus and biased by one of the biasing members.

FIG. 10 is a left-side sectional view illustrating, in an enlarged manner, the portion around the cartridge 4*x* mounted in the image forming apparatus 100 with the door 10 closed.

Like each of the color developer cartridges 4*y*, 4*m*, 4*c*, and 4*k*, the monochrome cartridge 4*x* has a biased surface 41*x* in the trailing-end surface of the monochrome cartridge 4*x* being inserted into the apparatus main body 101. If the monochrome cartridge 4*x* is mounted in the apparatus main body 101 and the door 10 is closed, the leading end of one of or the leading ends of some of the corresponding biasing members 11 are brought into contact with the biased surface 41*x*, and thereby bias the monochrome cartridge 4*x* towards the drum 1. It may be conceivable that if the monochrome cartridge 4*x* is mounted in the apparatus main body 101 and the door 10 is closed, all the biasing members 11 bias the monochrome cartridge 4*x* towards the drum 1. Such a configuration, however, may possibly have a problem of applying too large a pressure to bias the monochrome cartridge 4*x*. An adequate pressure value must be secured to bias the developing roller 40 against the drum 1. To this end, the shape of the monochrome cartridge 4x is designed to allow not all the biasing members 11 to be in contact with the biased surface 41x of the monochrome cartridge 4x when the monochrome cartridge 4x is mounted in the apparatus main body 101 and the door 10 is closed. To put it differently, if the monochrome cartridge 4x is mounted in the apparatus main body 101, at least one of the biasing members 11 is prevented from being in contact with the monochrome cartridge 4x, and the other biasing member, or members 11 are used to bias the monochrome cartridge 4x. To be specific, in this embodiment, the monochrome cartridge 4x has a step-like rear structure, where the biased surface 41x is formed. Of the four biasing members 11y, 11m, 11c, and 11k, the lower biasing members 11c and 11k do bias the monochrome cartridge 4x, but the two upper biasing member 11y and 11m do not because these two biasing member 11y and 11m are not in contact with the monochrome cartridge 4x. Note that the monochrome cartridge 4x is heavier than each one of the color developer cartridge 4y, 4m, 4c, and 4k. To securely bias the heavier monochrome cartridge 4x, plural biasing members 11 are used to bias the monochrome cartridge 4x in this embodiment.

There are various ways that allow the image forming apparatus 100 to distinguish each of the cartridges 4y, 4m, 4c, and 4k for color printing from the monochrome cartridge 4x for monochrome printing. For instance, a memory tag (not illustrated) or the like is provided on an external surface of the cartridge frame. A memory-tag reader (not illustrated) to read the cartridge information of the memory tag is provided in the apparatus main body 101 to identify the type of the cartridge currently mounted in the apparatus main body 101. With this configuration, it is possible to know easily whether the developer cartridge currently mounted in the apparatus main body 101 is the monochrome cartridge 4x or the cartridges for color printing.

As has been described thus far, the monochrome cartridge 4x of this embodiment occupies the four cartridge mounting portions 102y, 102m, 102c, and 102k. Therefore, either the single monochrome cartridge 4x or a set of the four cartridges 4y, 4m, 4c, and 4k can be mounted in the apparatus main body 101. Alternatively, the monochrome cartridge 4x may be formed to occupy either two or three adjacent cartridge mounting portions 102. In this case, the single monochrome cartridge 4x can be mounted in the apparatus main body 101 in place of two or three cartridges 4.

Suppose an apparatus configured in such a manner that the monochrome cartridge 4x is formed to occupy the three adjacent cartridge mounting portions 102 and is mounted in the apparatus main body 101 in the three cartridge mounting portions 102m, 102c, and 102k in place of the three cartridges 4m, 4c, and 4k. In this case, if the cartridge 4y is mounted in the cartridge mounting portion 102y, bi-color images can be formed by using the cartridge 4x and the cartridge 4y. Alternatively, suppose another apparatus configured in such a manner that the monochrome cartridge 4x is formed to occupy the two adjacent cartridge mounting portions 102, and is mounted in the apparatus main body 101 in the two cartridge mounting portions 102c and 102k in place of the two cartridges 4c and 4k. In this case, another monochrome cartridge 4x with the same structure can be mounted in the cartridge mounting portions 102y and 102m in place of the two cartridges 4y and 4m. If two monochrome cartridges 4x containing developers of different colors are mounted, bi-color images can be formed.

Note that each of the cartridges of this embodiment includes a developing roller that carries the toner to develop the electrostatic latent image. Such a configuration, however, is not the only possible configuration. Alternatively, for instance, each cartridge may include only the toner container that contains the toner, and the cartridge, or the cartridges with such a configuration are mounted in or removed from the apparatus main body 101.

In the invention of the present application, the same guide portions 25 are used commonly to guide the cartridge group, i.e. the cartridges 4, and to guide the alternative cartridge, i.e. the monochrome cartridge 4x, as described above. Accordingly, the apparatus main body 101 needs no guide portions exclusively used for the monochrome cartridge 4x. Consequently, the image forming apparatus 100 has a simpler structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-281054 filed Dec. 16, 2010, which is hereby incorporated by reference herein in its entirety.

What is claimed is:

1. An image forming apparatus comprising:

an apparatus main body including a transport unit configured to transport a print medium, and configured to allow a cartridge group and an alternative cartridge to be mounted therein;

the cartridge group including a plurality of cartridges each including a developer container configured to contain a developer to visualize an electrostatic latent image, the plurality of cartridges being mountable simultaneously in the apparatus main body;

the alternative cartridge including a developer container configured to contain a developer to visualize an electrostatic latent image, the developer container of the alternative cartridge having a larger capacity than each of the developer containers of the cartridge group; and plural mounting spaces in each of which a corresponding cartridge in the cartridge group is mounted, wherein if the cartridge group is mounted in the apparatus main body, the cartridges in the cartridge group occupy the corresponding mounting spaces, and if the alternative cartridge is mounted in the apparatus main body, the alternative cartridge occupies two or more of the plural mounting spaces, wherein the apparatus main body includes:

an opening portion through which the cartridge group or the alternative cartridge is mounted in the apparatus main body;

an opening/closing member movable between a closing position where the opening/closing member covers the opening portion and an opening position where the opening/closing member uncovers the opening portion; and plural biasing members provided corresponding to the plural mounting spaces, respectively, and configured to bias the cartridge group or the alternative cartridge towards the apparatus main body by being in contact with a biased surface of the cartridge group or the alternative cartridge when the opening/closing member is at the closing position, and wherein when the alternative cartridge is mounted in the apparatus main body, at least one of the plural biasing members is not in contact with the alternative cartridge, and the other biasing members are in contact with the alternative cartridge and thereby bias the alternative cartridge.

2. The apparatus according to claim 1, wherein the guided portions of the alternative cartridge are fit into the lowermost one of the plural pairs of guide portions.

3. The apparatus according to claim 1, wherein each of the cartridges and the alternative cartridge has a developing roller that carries a toner to develop the electrostatic latent image.

4. The apparatus according to claim 1, further comprising plural pairs of guide portions, each pair including guide portions formed at two ends of a corresponding one of plural mounting spaces formed adjacent one after another, wherein each of the cartridges in the cartridge group includes a pair of guided portions to be guided by one of the pairs of guide portions, wherein the alternative cartridge includes a pair of guided portions to be guided by one of the pairs of guide portions, and wherein the pair of guide portions used by the alternative cartridge is one of the pairs of guide portions usable by the cartridge group.

* * * * *